US009874051B2

(12) United States Patent
Kanhai

(10) Patent No.: US 9,874,051 B2
(45) Date of Patent: Jan. 23, 2018

(54) ONESHOT

(71) Applicant: Benjamin Kanhai, San Francisco, CA (US)

(72) Inventor: Benjamin Kanhai, San Francisco, CA (US)

( * ) Notice: Subject to any disclaimer, the term of this patent is extended or adjusted under 35 U.S.C. 154(b) by 317 days.

(21) Appl. No.: 14/619,072

(22) Filed: Feb. 11, 2015

(65) Prior Publication Data

US 2015/0337588 A1 Nov. 26, 2015

Related U.S. Application Data

(60) Provisional application No. 61/939,285, filed on Feb. 13, 2014.

(51) Int. Cl.
*E05G 1/12* (2006.01)
*E05G 1/02* (2006.01)

(52) U.S. Cl.
CPC ..... *E05G 1/12* (2013.01); *E05G 1/02* (2013.01)

(58) Field of Classification Search
CPC .... E05G 1/02; E05G 1/12; G01N 2001/2244; G01N 33/4972; G01N 33/98; B67D 1/0882; B67D 1/0888; B67D 1/0845
See application file for complete search history.

(56) References Cited

U.S. PATENT DOCUMENTS 7,483,862 B1 * 1/2009 Robinson ..... G06Q 20/3674 705/52
7,934,577 B2 * 5/2011 Walter ..... B60K 28/063 180/272
8,655,732 B1 * 2/2014 Wilinski ..... B67D 7/34 705/15
2016/0155127 A1 * 6/2016 Hartman ..... G06Q 20/206 705/18

* cited by examiner

*Primary Examiner* — Blake A Tankersley

(57) ABSTRACT

A safe that is unopenable and uses solar energy to dispense via a infrared remote signal a single or double, 1.5 oz shot of hard alcohol every night between the hours of 10 pm and 12 am. Featuring a oneway pump which intakes alcohol into the glass lined reservoir and a tamper proof z shaped nozzle composed of titanium to dispense. Also requires a breathalyzer and identity check of the user. The breathalyzer will use near infrared spectroscopy and also have additional optical filters which check for the organic compounds nitrogen and carbon dioxide present in human breath. The identity check may be done by iris scan or facial recognition scan and may require to have face aligned with both the camera and breathalyzer holes. May also feature a refrigeration system on the bottom of the safe using a Stirling heat engine to power the compressor.

2 Claims, 1 Drawing Sheet

ONESHOT

BACKGROUND

Abuse of alcohol is a known and very serious problem affecting our world today. When people start consuming alcohol they often have a hard time stopping while intoxicated and over indulge leading to severe sickness and hangover. The recommended daily dose of alcohol is one to two drinks per day. Currently there are no known indestructible and unopenable devices for dosing small amounts of alcohol within a 24 hour period wherein a large amount of stored alcohol remains inaccessible.

Field of the Invention

The present invention relates to safes and liquid dispensers.

Description of the Related Art

It is unknown in the prior art for a safe to be a liquid dispenser. Furthermore it is unknown for a safe to be unopenable as preferred in one embodiment. The most relevant prior art are safes used for the storage of valuables and to secure guns as shown in U.S. Pat. No. 5,416,826 A Gun safe. U.S. Pat. No. 3,347,212 A Time controlled liquid dispenser showing a means of dispensing small amounts of liquid for herds of livestock. U.S. Pat. No. 4,678,809 A Injectable formulations of disulfuram for the treatment of alcoholism is used produce an acute sensitivity to alcohol thus causing an unpleasant reaction when alcohol is consumed.

SUMMARY OF INVENTION

The present invention seeks to solve this problem by providing a way of securely storing alcohol where it is only available in small doses at certain times specifically late night hours. The night time preference set allows for a bedtime setting where drinking more may not be desired do to sleepiness setting in. Also allows the user to look forward to a treat at the end of the day as this may be beneficial to some who suffer from alcoholism. A daily drinking regime of one or two drinks has shown significant results in raising HDL cholesterol.

DETAILED DESCRIPTION OF THE INVENTION

Figures 1, 2, 3, 4, 5, 6:
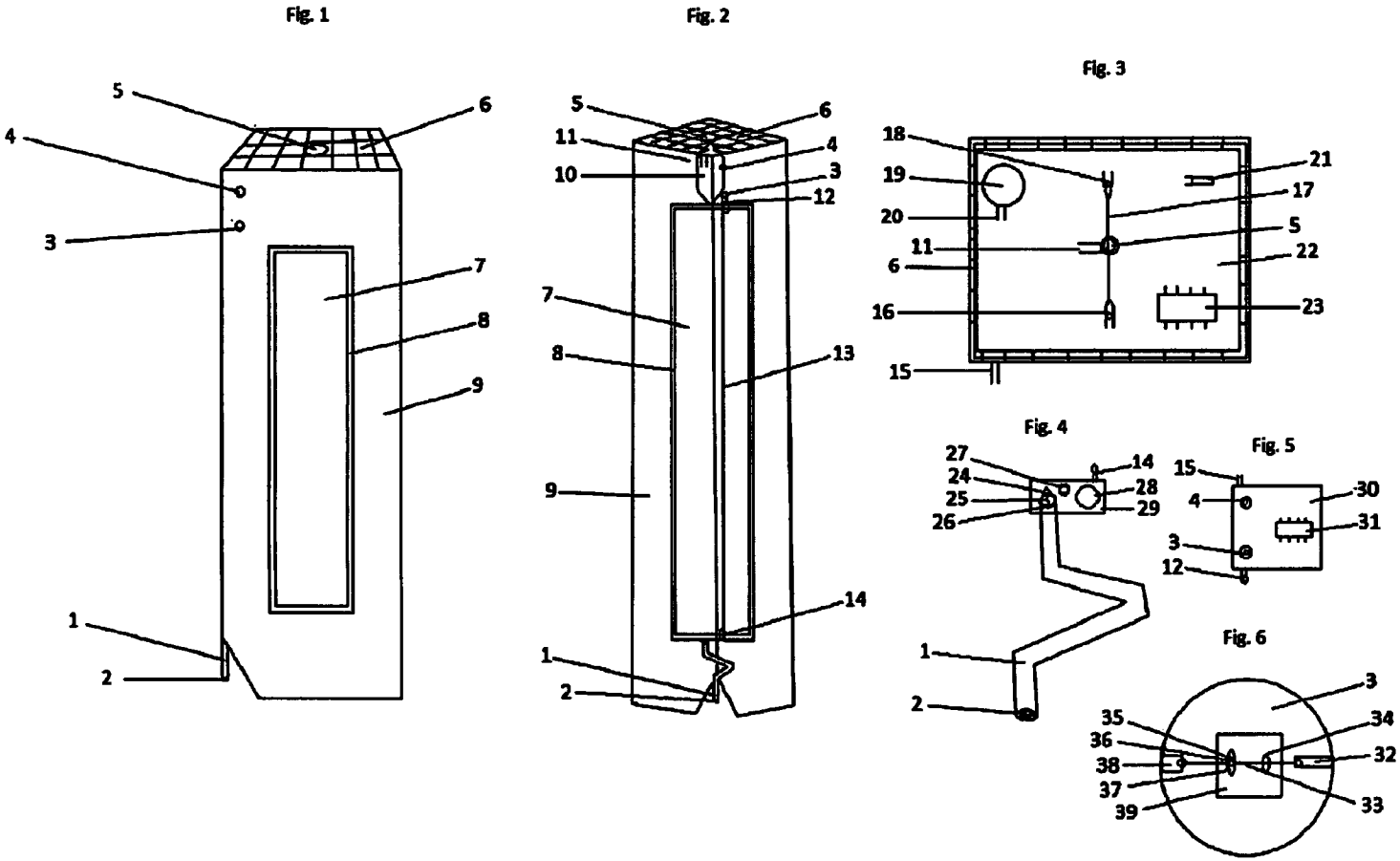
FIG. 1 showing the front view.
FIG. 2 showing the side view.
FIG. 3 showing the perspective view under the top lid.
FIG. 4 showing detailed perspective view of nozzle and dispensing means.
FIG. 5 showing camera and breathalyzer.
FIG. 6 showing detailed view of the inside of the near infrared spectroscopy breathalyzer.

It is preferred that only one general embodiment be made and settings be kept to those who follow normal circadian rhythm sleep patterns. Certain elements may be replaced to be catered toward the user's preference. Now in reference to the drawings; FIG. 1 showing the (1) nozzle may be composed of titanium due to its strength and non-ferrous property. The z shape prevents access to storage reservoir for alcohol storage using a tool such as a snake while the (2) metal screen will prevent objects from being inserted in. The (3) near infrared breathalyzer featuring additional optical filters for nitrogen and carbon dioxide. The (4) camera will be used to take initial picture and store it to memory in the (31) microprocessor and to perform an iris or facial recognition scan. The (5) intake hole is where a bottle may be inserted in an upright position to receive liquid. The (6) solar panel collects light energy and stores it to the battery. The (7) storage reservoir in one embodiment may have underneath it a Stirling refrigeration system such as Pat. No. EP 0844446 A1 using heat such as candle to power the compressor. The (8) inner lining is preferred to be glass but may also be ceramic in one embodiment or may be composed of charred oak wood for whiskey drinkers in another embodiment. The (9) mild steel may be alloyed with hardened steel closer to the reservoir in one embodiment or may be composed entirely of titanium or an alloy of titanium and chromium. Approximate dimensions may vary depending on type of alcohol being dispensed and wall thickness may be between ½ to two inches. FIG. 2 showing the (10) one-way low energy pump will be slightly off center from underneath the intake hole to prevent drilling straight into the pump and will be protected under heavy concentration of steel and will be powered by the battery via the (11) pump circuit connection. The dispensing signal will be sent using the (12) near infrared light diode via a (13) near infrared light beam signal that will connect to the (14) photo sensor and transmit the dispense amount to the microprocessor shown as drawing specification number (27). FIG. 3 showing where energy will be supplied via (15) copper pin out to printed circuit board housing the camera and breathalyzer. The liquid intake signal will be sent via the (16) near infrared light diode which will send a (17) near infrared light beam to the (18) photo sensor to prompt pump liquid intake and will also cheek for vertical liquid flow thereby preventing pump activation when safe is upside down. The (19) rechargeable lithium ion battery is preferred to be along lasting 10 year battery and will receive energy via the (20) copper input wires to receive from the (6) solar panel. A (21) crystal oscillator may be used for maintaining clock frequency. The (22) printed circuit board will connect all devices to make a complete circuit. The (23) 555 integrated timer circuit will be used to keep time but may be replaced in one embodiment by a radio clock transmitter or a quantum clock chip as specified in Pat No. US 20060022761 A1. FIG. 4 showing the (24) electric motor that will rotate the (25) metal pin which is inserted through the center of the (26) rotatable lid of nozzle and will receive a signal to rotate via the (27) microprocessor. In one embodiment the rotatable lid may be replaced by a spring trigger drive mechanism. The (28) lithium ion battery which may be long lasting or rechargeable will send pulse energy to rotate the electric motor for the amount the user. In one embodiment the battery may be replaced by a direct ethanol fuel cell. All of which will be housed on the (29) printed circuit board. FIG. 5 showing the (30) printed circuit board powered via the copper pin out (15) which also houses the (3) breathalyzer, (4) camera and the (31) integrated circuit which is used to process user identity and sobriety information and to communicate a signal of dispense amount via (12) near infrared light diode or to resist dispensing if the requirements have not been met. FIG. 6 showing a detailed view of the (3) near infrared spectrometry breathalyzer. Using a (32) near infrared light diode to shine a (33) near infrared light beam through the (34) prism, as well as the (35) carbon dioxide optical filter (36) ethanol optical filter and (37) nitrogen optical filter to the (38) photo sensor will transmit spectral data of breath to the (31) microprocessor for analyzation. All samples will be collected in the (39) breath collection chamber. In one embodiment another form of breathalyzer may be used such as the electrochemical fuel cell breathalyzer. The length of time blown into the breath collection chamber will also determine the amount of shots to dispense, one second for one shot and two seconds for two shots. To make the safe one may start with a frame and weld the walls into place or start with an iron cast mold. Epoxy the glass lining, weld on the top lid after all the proper holes and devices are attached with software installed. It must remain unopenable at preventing access to alcohol. Controls should not be available to change the times as this may cause the user to drink during the day time hours. It is highly recommended that user remove all other alcohol from the household.

The invention claimed is:

1. A safe comprising:

an outer shell comprising mild steel at an outer portion thereof and hard steel at an inner portion thereof, said outer shell having a core lined with glass;

a battery;

solar panel for receiving light energy to be stored in said battery;

a tamper resistant zigzag shaped nozzle where alcohol is released;

an intake hole and a pump activated by near infrared light to intake alcohol into said glass lined hollow core;

a timer circuit for regulating dispense times;

a processor for processing breathalyzer and camera input information;

a camera for determining identity of the user;

a breathalyzer for determining the sobriety of the user;

a microprocessor for dispensing amount of alcohol specified by user.

2. The safe according to claim 1, wherein the breathalyzer includes a carbon dioxide optical filter and a nitrogen optical filter.

* * * * *